US006385416B1

(12) United States Patent
Horikawa et al.

(10) Patent No.: US 6,385,416 B1
(45) Date of Patent: May 7, 2002

(54) SPACE SECURING MEMBER, DEVELOPING DEVICE, CHARGING DEVICE AND PROCESS CARTRIDGE

(75) Inventors: Tadashi Horikawa, Susono; Atsushi Numagami, Hadano; Kazunari Murayama; Takahito Ueno, both of Shizuoka-ken, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/710,862

(22) Filed: Nov. 14, 2000

(30) Foreign Application Priority Data

Nov. 19, 1999 (JP) ..... 11-329101

(51) Int. Cl.[7] ..... G03G 15/00; G03G 15/02; G03G 15/08

(52) U.S. Cl. ..... 399/111; 399/176; 399/279

(58) Field of Search ..... 399/111, 115, 399/116, 119, 174, 176, 279

(56) References Cited

U.S. PATENT DOCUMENTS

| | | | | | |
|---|---|---|---|---|---|
| 4,339,196 | A | * | 7/1982 | Beck et al. | 399/119 |
| 5,146,280 | A | * | 9/1992 | Kisu | 399/176 |
| 5,283,616 | A | | 2/1994 | Numagami et al. | 355/245 |
| 5,383,011 | A | | 1/1995 | Numagami et al. | 355/298 |
| 5,500,714 | A | | 3/1996 | Yashiro et al. | 355/200 |
| 5,543,898 | A | | 8/1996 | Shishido et al. | 355/210 |
| 5,585,895 | A | | 12/1996 | Yashiro et al. | 355/215 |
| 5,617,579 | A | | 4/1997 | Yashiro et al. | 399/114 |
| 5,629,755 | A | * | 5/1997 | Ohtsuka | 399/176 |
| 5,666,608 | A | * | 9/1997 | Christensen | 399/176 |
| 5,678,148 | A | * | 10/1997 | Owada et al | 399/279 |
| 5,689,774 | A | | 11/1997 | Shishido et al. | 399/111 |
| 5,768,658 | A | | 6/1998 | Watanabe et al. | 399/111 |
| 5,768,660 | A | * | 6/1998 | Kurihara et al. | 399/111 |
| 5,790,923 | A | | 8/1998 | Oguma et al. | 399/106 |
| 5,873,019 | A | * | 2/1999 | Mizuishi | 399/176 X |
| 5,920,753 | A | | 7/1999 | Sasaki et al. | 399/111 |
| 5,937,239 | A | | 8/1999 | Watanabe et al. | 399/111 |
| 5,937,242 | A | | 8/1999 | Yokoyama et al. | 399/114 |
| 5,966,566 | A | | 10/1999 | Odagawa et al. | 399/109 |
| 5,966,568 | A | | 10/1999 | Numagami et al. | 399/111 |
| 6,006,058 | A | | 12/1999 | Watanabe et al. | 399/167 |
| 6,016,413 | A | | 1/2000 | Yokoyama et al. | 399/113 |
| 6,029,032 | A | | 2/2000 | Watamabe et al. | 399/111 |
| 6,097,908 | A | | 8/2000 | Uchiyama et al. | 399/111 |
| 6,097,909 | A | | 8/2000 | Watanabe et al. | 399/111 |
| 6,101,354 | A | | 8/2000 | Nakagawa et al. | 399/225 |
| 6,118,960 | A | | 9/2000 | Nakagawa et al. | 399/111 |
| 6,131,007 | A | | 10/2000 | Yamaguchi et al. | 399/256 |
| 6,131,011 | A | | 10/2000 | Kojima et al. | 399/351 |
| 6,157,792 | A | | 12/2000 | Mori et al. | 399/24 |
| 6,169,866 | B1 | | 1/2001 | Watanabe et al. | 399/111 |

FOREIGN PATENT DOCUMENTS

JP 60-128466 * 7/1985

* cited by examiner

*Primary Examiner*—Fred L. Braun
(74) *Attorney, Agent, or Firm*—Fitzpatrick, Cella, Harper & Scinto

(57) ABSTRACT

A space securing member defines a predetermined space between the first rotary member and the second rotary member which is arranged apart from the first rotary member with the predetermined space. The space securing member is provided with a circular hole that is rotatably supported by one of the first and second rotary members, and an arc-shaped portion that is in area contact with an outer peripheral surface of the other rotary member. The space securing member is used to provide a predetermined space between a charging roller and a photosensitive drum and/or a developing roller and the photosensitive drum.

13 Claims, 14 Drawing Sheets

SPACE SECURING MEMBER, DEVELOPING DEVICE, CHARGING DEVICE AND PROCESS CARTRIDGE

BACKGROUND OF THE INVENTION

1. Field of the Invention

The present invention relates to a process cartridge detachably mountable to a main body of an electrophotographic image forming apparatus, a space securing member between a photosensitive drum and a developing roller, a charging roller or the like, a developing device and a charging device.

In the present specification, the electrophotographic image forming apparatus forms an image on a recording medium with using an electrophotographic image forming process. The electrophotographic image forming apparatus may be exemplified by, for example, an electrophotographic copying machine, an electrophotographic printer (for example, a laser beam printer, an LED printer or the like), a facsimile machine, a word processor and so on.

Also, the process cartridge makes charging means, developing means or cleaning means and an electrophotographic photosensitive drum integrally into a cartridge which is detachably mountable to the main body of the electrophotographic image forming apparatus. The process cartridge also makes at least one of the charging means, the developing means and the cleaning means and an electrophotographic photosensitive drum integrally into a cartridge which is detachably mountable to the main body of the electrophotographic image forming apparatus. The process cartridge further makes at least the developing means and the electrophotographic photosensitive drum integrally into a cartridge which is detachably mountable to the main body of the electrophotographic image forming apparatus.

2. Related Background Art

An image forming apparatus such as a printer using an electrophotographic process conducts image recording in such a manner that a photosensitive drum which constitutes an image bearing member is uniformly charged, the photosensitive drum is selectively exposed to form a latent image, the latent image is visualized by toner, which is a developer, the toner image is transferred onto a recording medium, and heat or pressure is applied to the transferred toner image, to thereby fix the toner image onto the recording medium.

The image forming apparatus thus structured may be accompanied by the supply of toner and the maintenance of various process means, and in such image forming apparatus the photosensitive drum, the charging means, the developing means, the cleaning means and so on are gathered within a frame and made into a cartridge as means for facilitating the supply of toner and the maintenance of the apparatus.

In the apparatus of the above type, the space between the photosensitive drum and a developing sleeve that supplies toner to the photosensitive drum must be maintained at a predetermined distance. As this method, a space securing member called an "SD runner" is disposed on an end portion of the developing sleeve, and the gap (hereinafter referred to as the "SD gap") between the photosensitive drum and the developing sleeve is managed by the thickness of the SD runner. Also, the photosensitive drum and the developing sleeve rotate mutually forward in such a manner that the peripheral surfaces of the photosensitive drum and the developing sleeve move in the same direction at the opposite portions of those members, and the SD runner holds the SD gap while rotating in that direction. In this system, the SD runner is urged by an urging force (hereinafter referred to as the "SD pressure") of a spring or the like so as not to separate an abutting portion of the SD runner from the photosensitive drum due to vibration or the like.

In a system using the SD runner, in the case where the rotating direction of the photosensitive drum and the rotating direction of the developing sleeve are in the forward direction, the SD gap can be maintained without any problem. However, in the case where the rotating direction of the photosensitive drum is counter to the rotating direction of the developing sleeve, the peripheral speed difference between the photosensitive drum and the developing sleeve becomes larger than that in the case where the photosensitive drum and the developing sleeve rotate in the forward direction. As a result, there is a fear that the SD runner may be worn away.

Also, in recent years, in a charging device that uniformly charges the photosensitive drum, there is a structure in which the SD gap between the photosensitive drum and the charging roller needs to be held constant. However, in this structure, the rotating directions of the photosensitive drum and the charging roller are also counter to each other.

SUMMARY OF THE INVENTION

An object of the present invention is to provide a space securing member which is capable of maintaining the space between rotary members with high accuracy, a developing device using the space securing member, a charging device using the space securing member and a process cartridge using the space securing member.

Another object of the present invention is to provide a space securing member which is capable of maintaining a space between an electrophotographic photosensitive drum and a developing roller with high accuracy, a developing device using the space securing member and a process cartridge using the developing device.

Still another object of the present invention is to provide a space securing member which is capable of maintaining a space between an electrophotographic photosensitive drum and a charging roller with high accuracy, a charging device using the space securing member and a process cartridge using the charging device.

Yet still another object of the present invention is to provide a space securing member having a circular hole rotatably supported by a rotary member and an arc configuration which is in area contact with an outer peripheral surface of another rotary member, a developing device using the space securing member, a charging device using the space securing member and a process cartridge using the space securing member.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

Hereinafter, a description will be given in more detail of preferred embodiments of the present invention with reference to the accompanying drawings.

In the following description, the term "longitudinal direction" is directed to a direction which crosses a conveying direction of a recording medium and is in parallel with a recording medium. Also, the term "right and left" is directed to the right and left when viewing the conveying direction of the recording medium from the upper side. Further, the term "upper" of the process cartridge is directed to the up direction in a state where the process cartridge is mounted.

Figure 1:
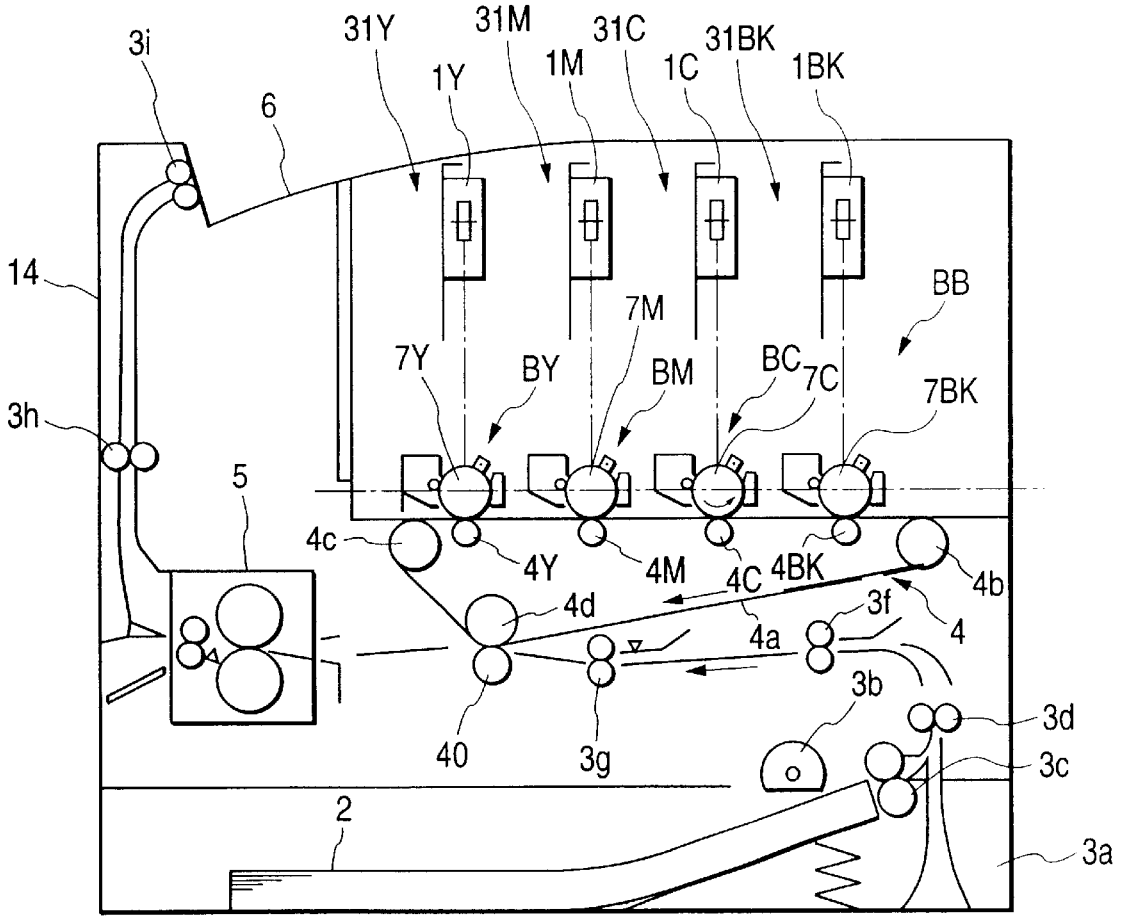
FIG. 1 is a vertical cross-sectional view showing an electrophotographic image forming apparatus.

FIG. 1 is a view showing an image forming apparatus to which the present invention is applied. The image forming apparatus is provided with: image forming stations 31Y, 31M, 31C and 31BK for forming toner images on photosensitive drums as image bearing members; an intermediate transfer belt 4*a* onto which the toner images are once transferred; a secondary transfer roller 40 which is transfer means that transfers the toner image formed on the intermediate transfer belt 4*a* onto the recording medium 2; sheet feeding means for feeding the recording medium 2 to a portion between the intermediate transfer belt 4*a* and the secondary transfer roller 40; sheet conveying means for conveying the recording medium 2 to the transfer means; fixing means; and sheet discharge means.

Hereinafter, the image formation operation will be described.

As shown in FIG. 1, a sheet feed cassette 3*a* that stacks and contains a plurality of recording media (for example, a recording sheet made of paper, an OHP sheet, a cloth and so on) 2 therein is detachably mounted onto the image forming apparatus. The recording media 2 conveyed from the sheet feed cassette 3*a* by a pickup roller 3*b* are separated into each sheet by a pair of retard rollers 3*c* and then conveyed to a pair of registration rollers 3*g* by conveying rollers 3*d* and 3*f*.

When the recording medium 2 is conveyed, the pair of registration rollers 3*g* stop to rotate, and the recording medium 2 is abutted against a nip portion of the paired registration rollers 3*g* to correct the skew feed of the recording medium 2.

In case of a 4 drum full color system, four photosensitive drums 7Y, 7M, 7C and 7BK for yellow, magenta, cyan and black are arranged in tandem by process cartridges BY, BM, BC and BB as shown in FIG. 1. Optical scanning systems 1Y, 1M, 1C and 1BK are disposed for the respective process cartridges BY, BM, BC and BB, and after toner images are formed on the photosensitive drums for the respective colors in response to an image signal, the respective color toners are superimposed and transferred by the transfer rollers 4Y, 4M, 4C and 4BK onto the intermediate transfer belt 4*a* which runs in a direction indicated by an arrow in FIG. 1.

Thereafter, the recording medium 2 is conveyed to the secondary transfer roller 40 at a predetermined timing, and the toner image on the intermediate transfer belt 4*a* is transferred onto the recording medium 2 and then fixed on the recording medium 2 by a fixing device 5. Thereafter, the recording medium 2 is discharged by a pair of discharge rollers 3*h* and 3*i* and then stacked on a tray 6 on a main body 14 of the apparatus.

The image forming stations 31Y, 31M, 31C and 31BK constitute the process cartridges BY, BM, BC and BB, respectively, except for the optical scanning systems 1Y, 1M, 1C and 1BK. As the structures of the process cartridges BY, BM, BC and BB are identical with each other, only the process cartridge BY will be described.

Figure 2:
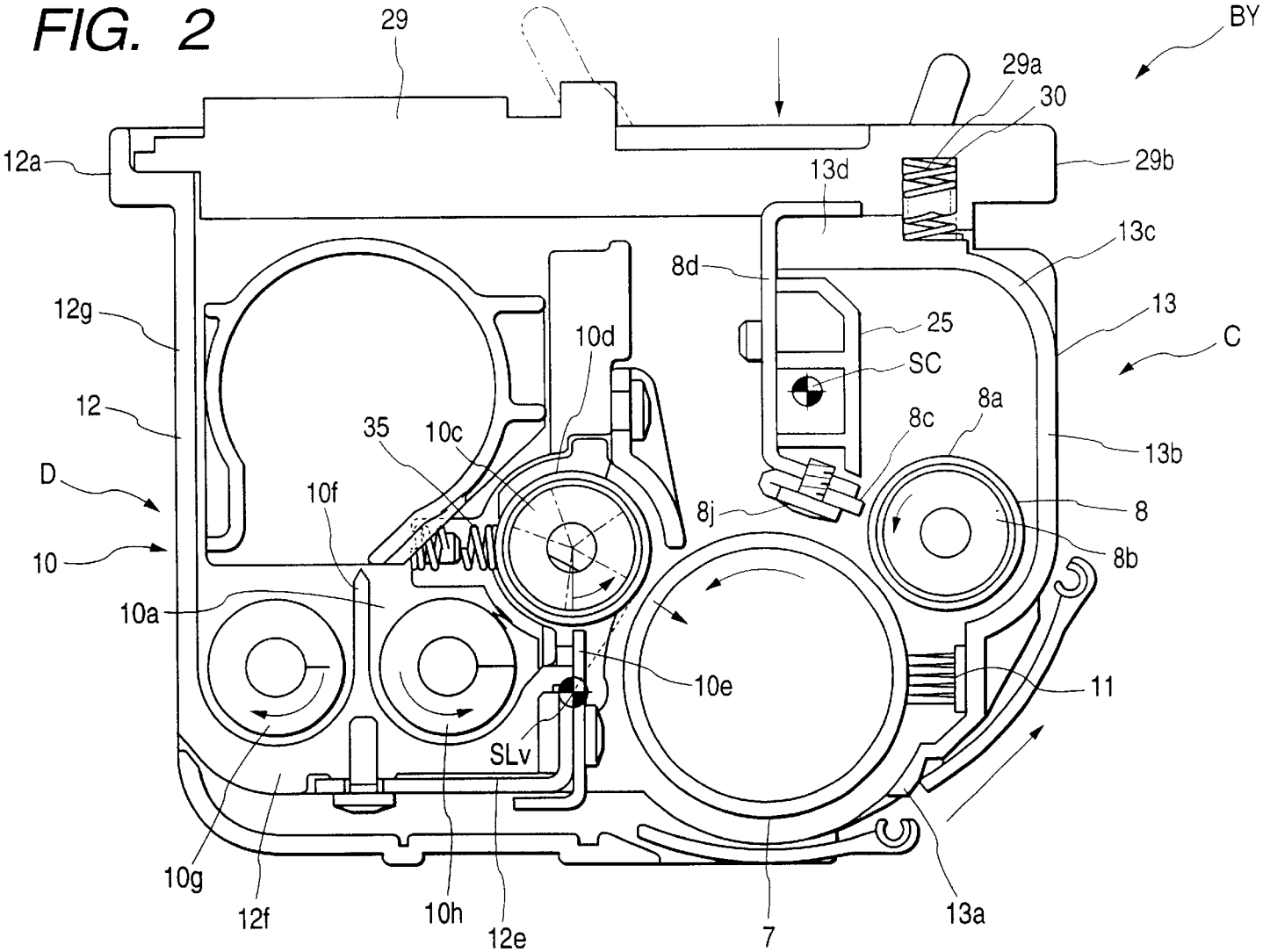
FIG. 2 is a vertical cross-sectional view showing a process cartridge.

As shown in FIG. 2, the process cartridge BY is designed in such a manner that charging means, an exposing section, developing means and a transfer opening are disposed around the photosensitive drum 7. In this embodiment, a two-component developer having magnetic carrier particles is employed. Therefore, the photosensitive drum 7 used in the embodiment of the present invention may be formed of an organic photoconductor that is usually employed, etc. Desirably, if a photosensitive drum having a surface layer made of a material having a resistance $10^2$ to $10^{14}$ Ω·cm on an organic photoconductor, an amorphous silicon photoconductor or the like is used, charge-injection charging can be realized, to thereby prevent the occurrence of ozone and to effect a reduction in power consumption. Also, the charging property can be improved.

Under the above circumstances, in this embodiment, a photosensitive drum 7 having a negatively chargeable organic photoconductor on a drum base made of aluminum is used.

The charging means is a magnetic brush charger 8 using magnetic carriers.

The charger 8 has a stationary magnet 8*b* within a hollow cylindrical charging roller 8*a* which is rotatably supported. After transferring, the toner remaining on the photosensitive drum 7 is taken in the charger 8 that rotates in a direction indicated by an arrow in FIG. 2.

In this embodiment, the developing means is applied with a method of development in a state where the two-component developer is in contact (two-component contact development).

FIG. 2 shows the developing means 10 for two-component magnetic brush development used in this embodiment. A developing roller (hereinafter referred to as a "developing sleeve") 10*d* is shaped in a hollow cylinder and rotatably supported. A stationary magnet 10*c* is disposed within the developing sleeve 10*d*. The developing sleeve 10*d* rotates in the same direction as that of the photosensitive drum 7, and the peripheral surface of the developing sleeve

10*d* moves in a direction counter to the moving direction of the peripheral surface of the photosensitive drum 7. The photosensitive drum 7 and the developing sleeve 10*d* are out of contact and a space of about 0.2 to 1.0 mm is provided between the photosensitive drum 7 and the developing sleeve 10*d* and is so set as to conduct development in a state where the developer is in contact with the photosensitive drum 7.

The toner mixed with the carriers is supplied by agitating screws 10*g* and 10*h* disposed within a casing partitioned by a longitudinal partition wall 10*f* except for both ends thereof. The toner supplied from a toner supply container (not shown) drops down to one end side of the agitating screw 10*g*, is fed in one direction along the longitudinal directions where the toner is agitated, and passes through a portion of the other end side where the partition wall 10*f* is not provided. Then, the toner is moved toward the agitating screw 10*h* side and is then moved to one end side by the agitating screw 10*h*. Thereafter, the toner passes through a portion of one end side where the partition wall 10*f* is not provided and is then moved to the agitating screw 10*g* side. Subsequently, the toner is agitated in the same manner and circulated.

Hereinafter, a description will be given of a developing process of visualizing an electrostatic latent image formed on the photosensitive drum 7 by using the developing means 10 through the two-component magnetic brush method and a circulating system of the developer. First, the developer drawn up by a pole of the magnet 10*c* with the rotation of the developing sleeve 10*d* is regulated by a regulating blade 10*e* disposed perpendicularly to the developing sleeve 10*d*, that is, the developing blade during a process where the developer is borne, and then formed into a thin layer on the developing sleeve 10*d*. When the developer formed into the thin layer is borne to a developing main pole, a magnetic brush is formed by a magnetic force. The electrostatic latent image on the photosensitive drum 7 is developed by the developer which stands like ears of rice, and thereafter the developer on the developing sleeve 10*d* is returned to the interior of the developer container 10*a* by a repulsive magnetic field.

A d.c. voltage and an a.c. voltage are applied to the developing sleeve 10*d* from a power source (not shown). In general, when the a.c. voltage is applied to the developing sleeve 10*d* in the two-component developing method, the developing efficiency increases to make a high-grade image. Conversely, the image may be fogged. For that reason, a potential difference is provided between the d.c. voltage that is applied to the developing sleeve 10*d* and the surface potential of the photosensitive drum 7, to thereby prevent the toner from being stuck to a non-image area during the developing operation.

The toner image is then transferred to the intermediate transfer belt 4*a* by the intermediate transfer device 4. The intermediate transfer device 4 is designed in such a manner that an endless belt 4*a* is put around a driving roller 4*b*, a driven roller 4*c* and a secondary transfer opposite roller 4*d* and then rotated in a direction indicated by an arrow in FIG. 1. In addition, the transfer charging rollers 4Y, 4M, 4C and 4BK are disposed within the transfer belt 4*a*, and a power is supplied from a high-voltage power source to the respective transfer charging rollers 4Y, 4M, 4C and 4BK while the respective transfer charging rollers 4Y, 4M, 4C and 4BK generate pressures from the inner side of the belt 4*a* toward the photosensitive drum 7, to thereby induce from the back side of the belt 4*a* the charge having a polarity opposite to the toner and sequentially transfer the toner image formed on the photosensitive drum 7 onto an upper surface of the intermediate transfer belt 4*a*.

The intermediate transfer belt 4*a* may be made of polyimide resin. The material of the belt 4*a* is not limited to polyimide resin, but may be preferably made of dielectric material, for example, polycarbonate resin, polyethylene terephthalate resin, polyvinylidene fluoride resin, polyethylene naphthalate resin, polyether ether ketone resin, polyether sulfone resin, plastic such as polyurethane resin, fluorine or silicone rubber.

The non-transferred toner remains on the surface of the photosensitive drum 7 from which the toner image has been transferred. When the non-transferred toner is allowed to pass through the charger as it is, a phenomenon (hereinafter referred to as a "ghost") may occur in which a charging potential on only the residual image portion drops, or a previous-image portion appears thinly or thickly on a succeeding image. Even if the non-transferred toner passes through the charging magnetic brush that is in contact with the photosensitive drum 7, in most cases, the configuration of the previous image remains. In order to solve the above problem, it is necessary to take the non-transferred toner that reaches the charging region in the magnetic brush charger 8 with the rotation of the photosensitive drum 7 to erase the history of the previous image. There are many cases in which the non-transferred toner positive and negative in polarity are mixed together on the photosensitive drum 7 due to the separation electric-discharge during the transferring operation. However, it is desirable that the non-transferred toner is positively charged taking the facilitation of the non-transferred toner in the magnetic brush charger 8 into consideration.

In this embodiment, an electrically conductive brush 11 is abutted against a portion of the photosensitive drum 7 between the intermediate transfer device 4 and the magnetic brush charger 8, and a bias having a polarity opposite to the charging bias is applied to the electrically conductive brush 11. The non-transferred toner positive in polarity passes through the magnetic brush charger 8, and the non-transferred toner negative in polarity is temporarily caught by the electrically conductive brush 11, and then fed to the photosensitive drum 7 again after the charge has been eliminated from the non-transferred toner. As a result, the non-transferred toner is more liable to be taken in the direction of the magnetic brush.

(Structure of Frame of Process Cartridge)

The process cartridge B (BY, BM, BC, BB) makes the electrophotographic photosensitive drum 7 and the developing means 10 integrally into a developing unit D by a developing frame 12, makes the charging roller 8*a*, the regulating blade 8*c*, the electrically conductive brush 11 and the like into an integral charging unit C by a charging frame 13, and assembles the charging unit C with the developing unit D. In addition, the developing unit D and the charging unit C are positioned and coupled together by a front cover 16 and a rear cover 17 (refer to FIG. 4) from both ends of the longitudinal direction.

Figure 3:
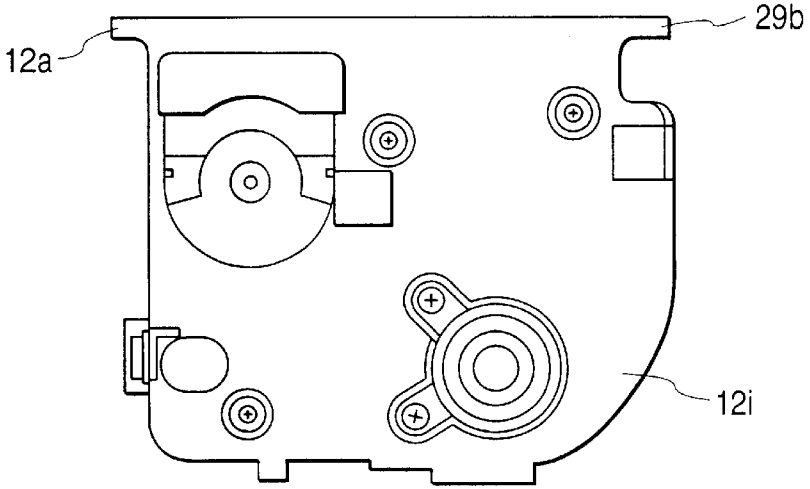
FIG. 3 is a front view showing the process cartridge.
Figure 4:
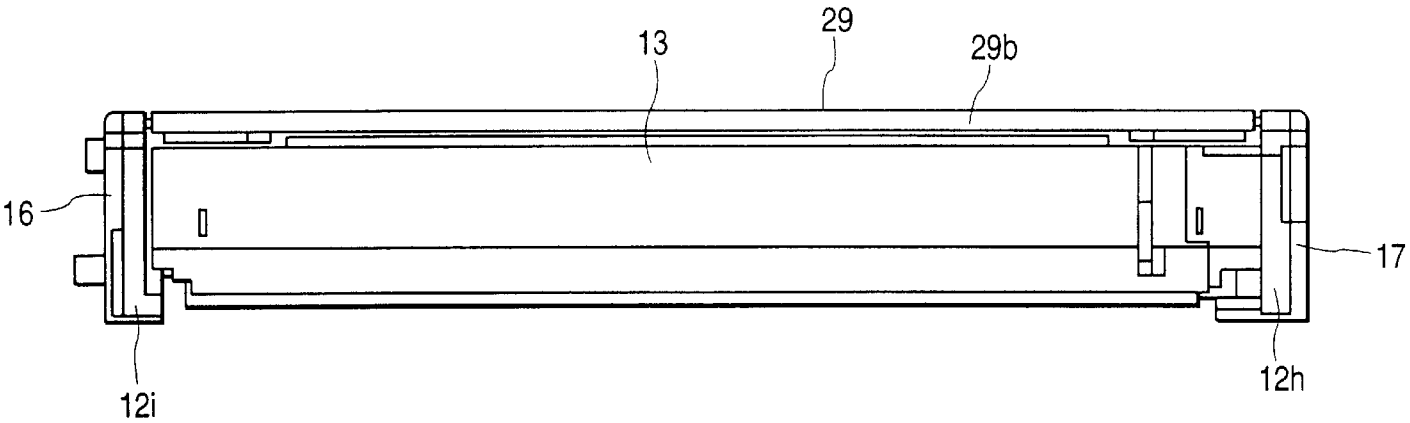
FIG. 4 is a right side view showing the process cartridge.
Figure 5:
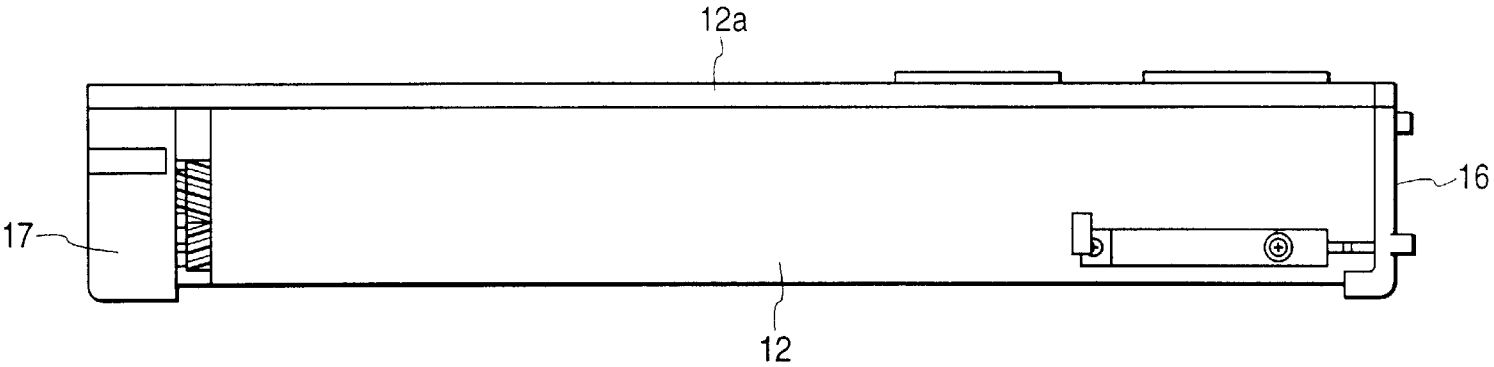
FIG. 5 is a left side view showing the process cartridge.
Figure 6:
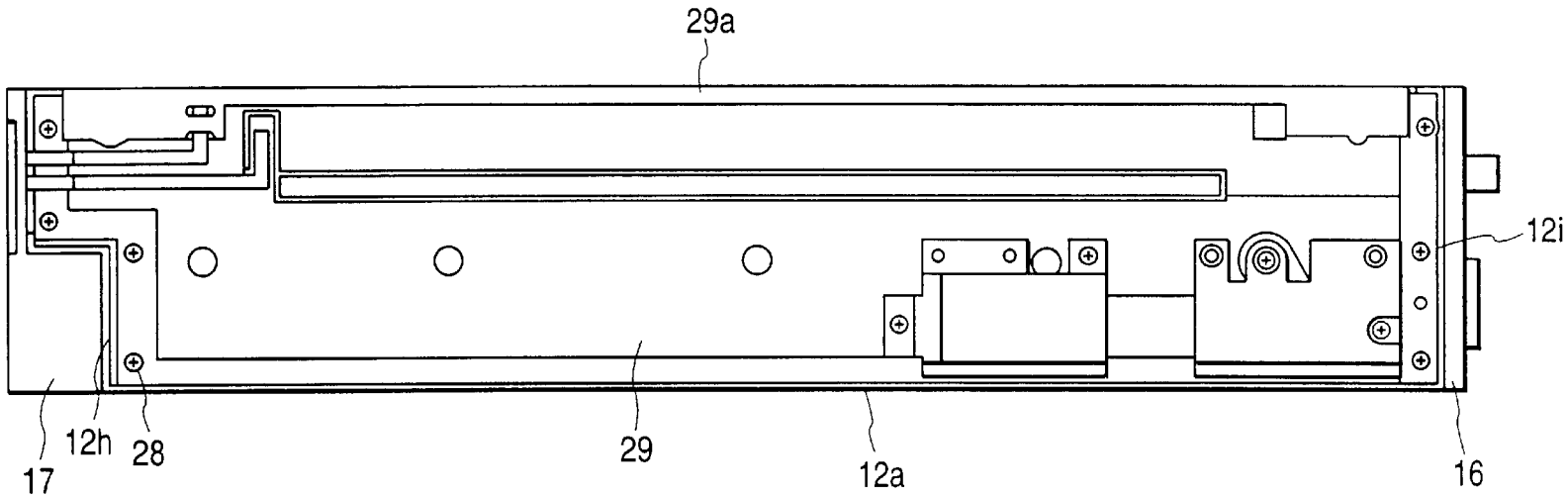
FIG. 6 is a plan view showing the process cartridge.
Figure 7:
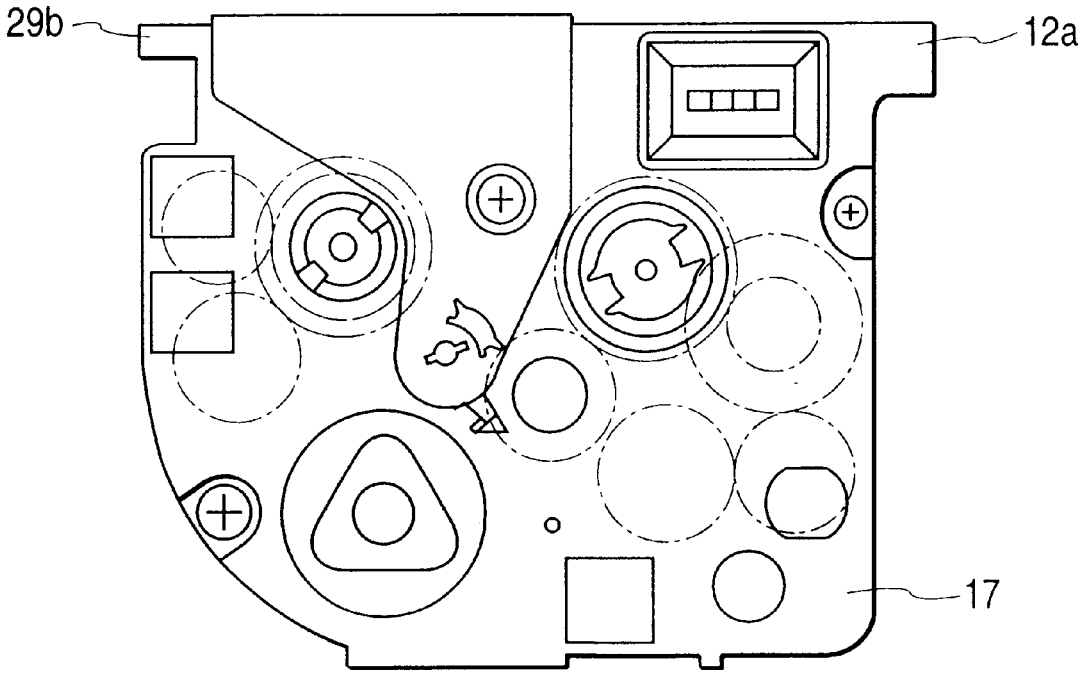
FIG. 7 is a back view showing the process cartridge.
Figure 8:
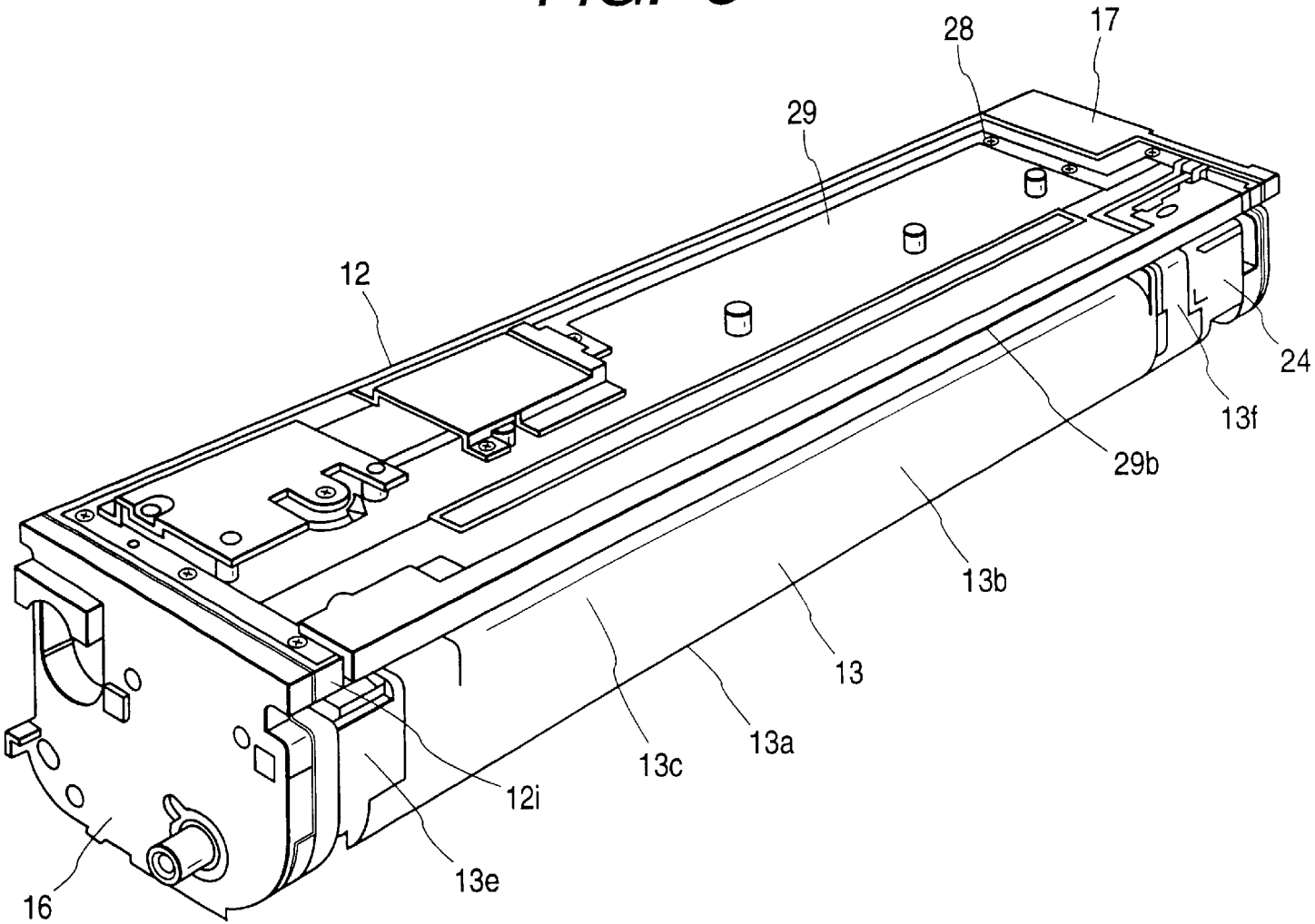
FIG. 8 is a perspective view showing the process cartridge viewed from a front right side thereof.
Figure 9:
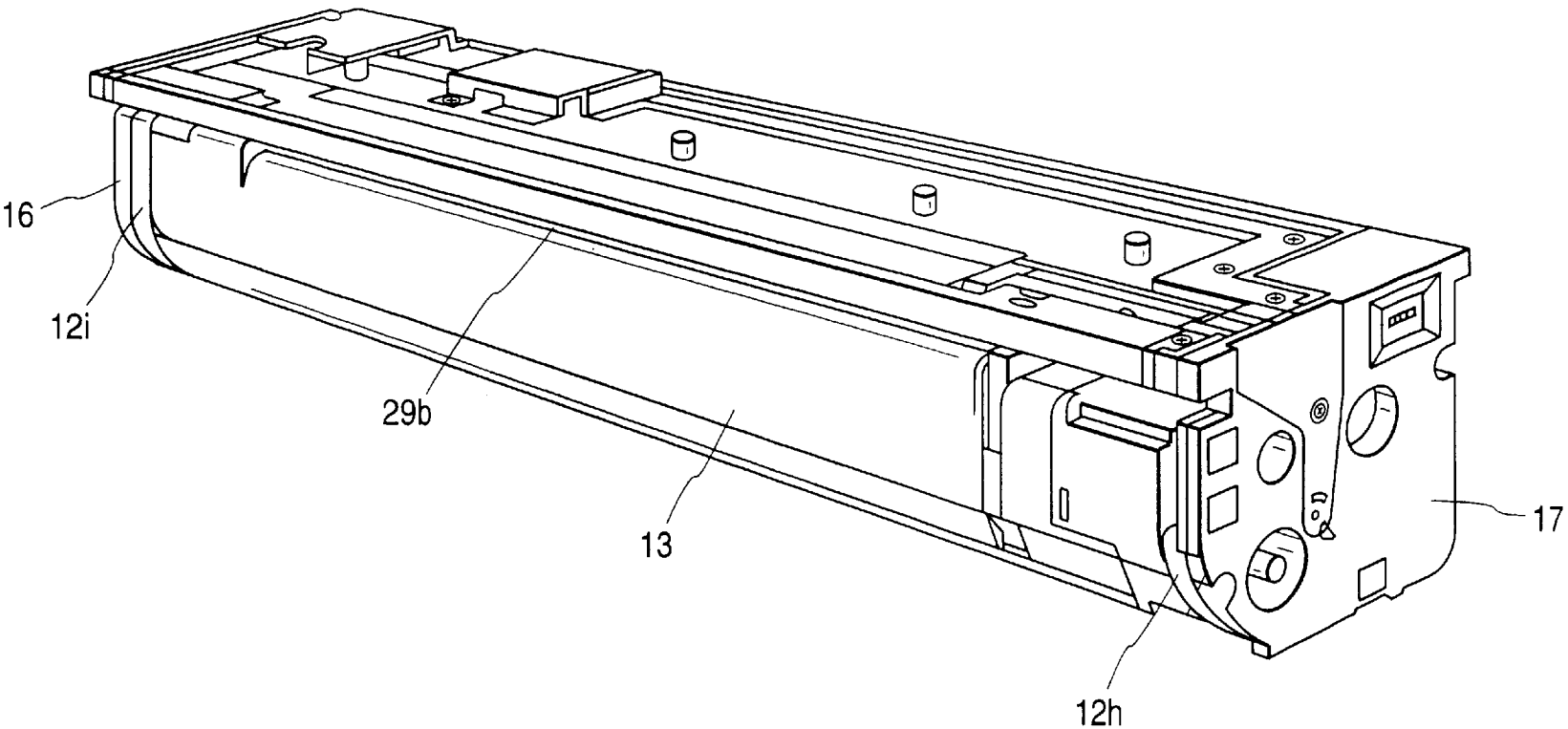
FIG. 9 is a perspective view showing the process cartridge viewed from a back left side thereof.
Figure 10:
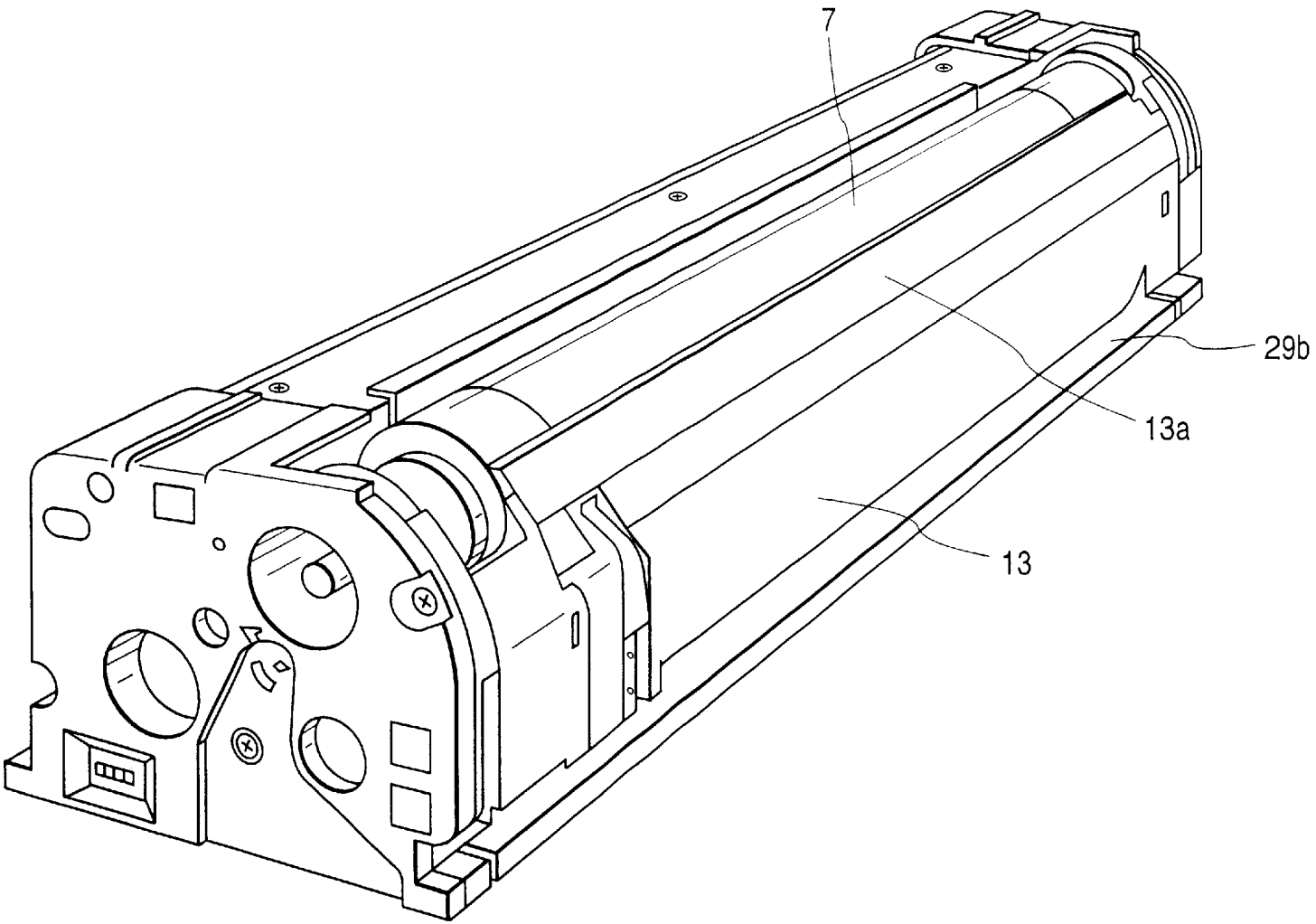
FIG. 10 is a perspective view showing the process cartridge which has been turned over and viewed from a back oblique side thereof.

FIGS. 3 to 7 are projection views showing the process cartridge B (BY, BM, BC, BB). FIG. 3 is a front view, FIG. 4 is a right side view, FIG. 5 is a left side view, FIG. 6 is a plan view and FIG. 7 is a back view. FIGS. 8 to 10 are perspective views of the appearance of the process cartridge B. FIG. 8 is a perspective view viewed from a front oblique side, FIG. 9 is a perspective view viewed from a back oblique side, and FIG. 10 is a perspective view viewed from a back oblique side when a side of a bottom view is turned upward.

Figure 12:
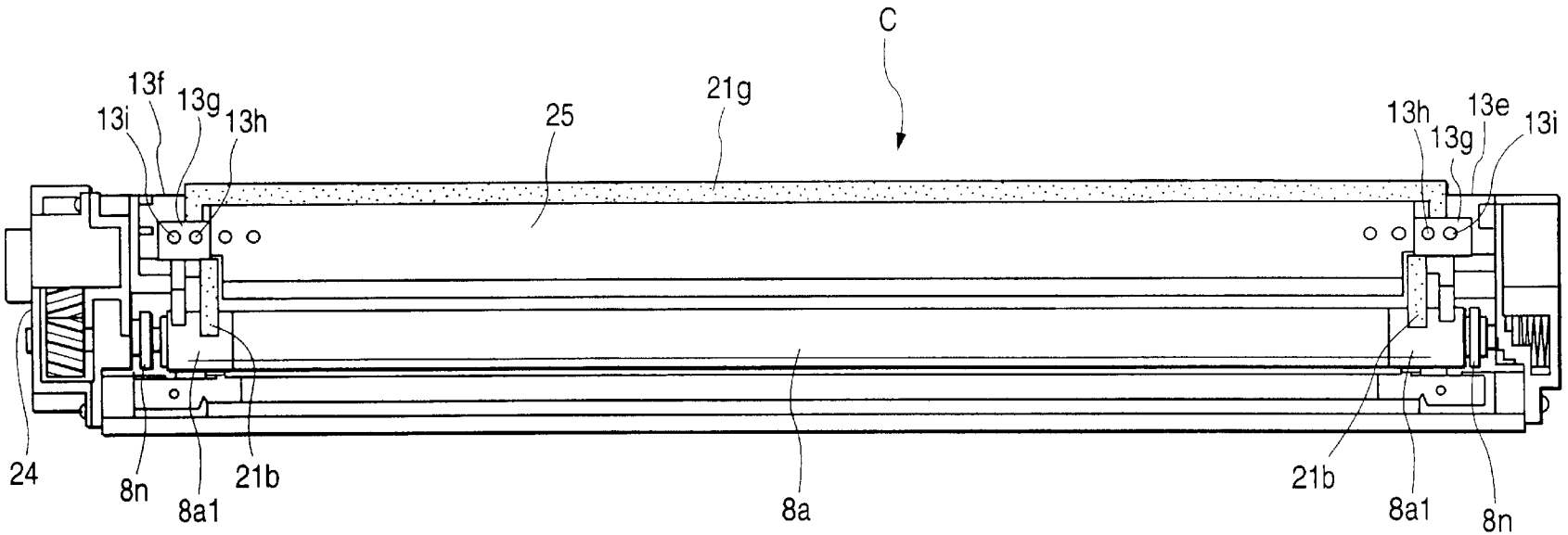
FIG. 12 is a front view showing the charging unit shown in FIG. 11 from which a blade is removed.

As shown in FIG. 2, the charging unit C makes the charging roller 8*a*, the regulating blade 8*c* and the electrically conductive brush 11 integral by the charging frame 13. As shown in FIGS. 2, 4, 8, 9 and 10, the charging frame 13 constitutes a part of the exterior of the process cartridge B. As shown in FIGS. 2 and 10, a lower edge 13*a* of the charging frame 13 is close to the photosensitive drum 7 and made in parallel with the photosensitive drum 7 with a space along the longitudinal direction. A substantially vertical wall 13*b* is so disposed as to form the exterior of the process cartridge B from the lower edge 13*a* and then curved at the upper portion to form a corner portion 13*c*. A top plate portion 13*d* is extended substantially horizontally from the corner portion 13*c* and key-shaped in section. A space is defined below the top plate portion 13*d*, and member attaching portions 13*e* and 13*f* are formed integrally on both end portions thereof in the longitudinal direction as shown in FIGS. 8 and 12. A horizontal member 25 is formed integrally with the charging frame 13 between the member attaching portions 13*e* and 13*f*.

Figure 11:
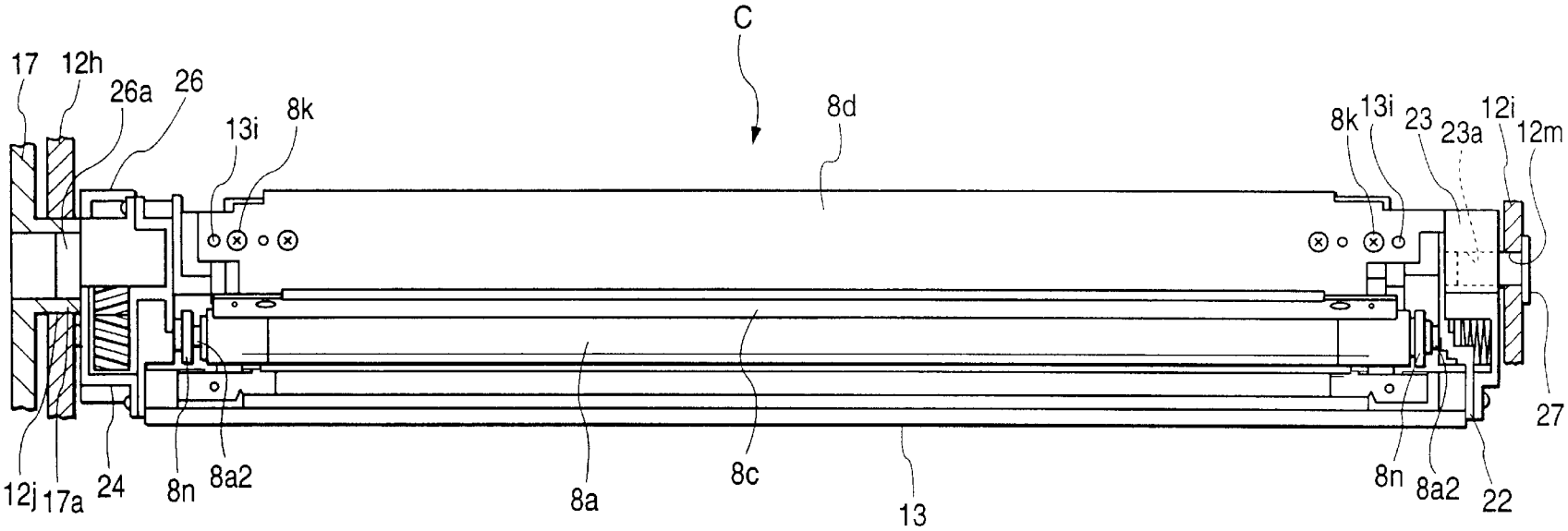
FIG. 11 is a front view showing a charging unit.

FIG. 11 is a side view of the charging unit C viewed from the inner side thereof. A charging roller bearing 22 and an end portion cover 23 are threaded together by a screw on one end of this side on the charging frame 13 in a direction of mounting the process cartridge B (mounted from the front of the apparatus main body 14 in the longitudinal direction). On the other end, a gear unit 24 is fixedly threaded by a screw.

FIG. 12 is a side view showing the charging unit C from which the regulating blade 8*c* and a support sheet metal 8*d* are removed. A blade attaching seat 13*g* formed by heightening the sides of the member attaching portions 13*e* and 13*f* by one step has a female screw 13*h* and a dowel 13*i* on a plane which is in contact with both ends of the regulating blade 8*c*, respectively, as shown in FIG. 12. A sealing material 21*g* such as sponge is stuck in the longitudinal direction onto the plane which retreats from the seat 13*g*. Also, a sealing member 21*b* such as felt is stuck along the peripheral direction of a sealing portion 8*a*1 on each end portion of the charging roller 8*a* in order to prevent the developer from being leaked toward the exterior in the axial direction. Accordingly, a portion of the charging frame 13 opposite to the sealing portion 8*a*1 on each end portion of the charging roller 8*a* is arc-shaped concentrically with the charging roller 8*a*.

The metal regulating blade 8*c* is arranged apart from the charging roller 8*a* with a space as shown in FIG. 2, and fixed onto the support sheet metal 8*e* by a small screw 8*j*. The support sheet metal 8*d* has a groove shape in section, and is fitted onto the dowel 13*i* of the seat 13*g* of the charging frame 13. Also, the small screw 8*k* is threaded into the female screw 13*h* of the seat 13*g* through a hole of the support sheet metal 8*d*, as a result of which the support sheet metal 8*d* and the seat 13*g* are abutted against each other, and the sealing material 21*g* is compressed by the support sheet metal 8*d*. Also, a portion close to the seat 13*g* of the sealing material 21*b* is compressed by the support sheet metal 8*d*. The support sheet metal 8*d* is extremely high in rigidity and both ends of the support sheet metal 8*d* are fixed to the charging frame 21 to stiffen the charging frame 21.

The process cartridges BY to BB are mounted to the apparatus main body 14 by inserting the longitudinal guide portions 12*a* and 29*b* into guide rails (not shown) of the apparatus main body 14 from a direction perpendicular to a paper surface of FIG. 1.

(Mounting of Charging Unit)

The charging unit C is supported by the developing frame 12 so as to be pivotable about a pivot center SC as shown in FIG. 2. With this structure, as shown in FIG. 11, a cylindrical shaft portion 26*a* is disposed on the pivot center SC on a gear case 26 of a gear unit 24 which is fixed to one end of the charging frame 13 on the depth side of the longitudinal direction, and a cylindrical hole 23*a* is defined on the pivot center SC on the end portion cover 23 at the other end of the longitudinal direction.

Figure 13:
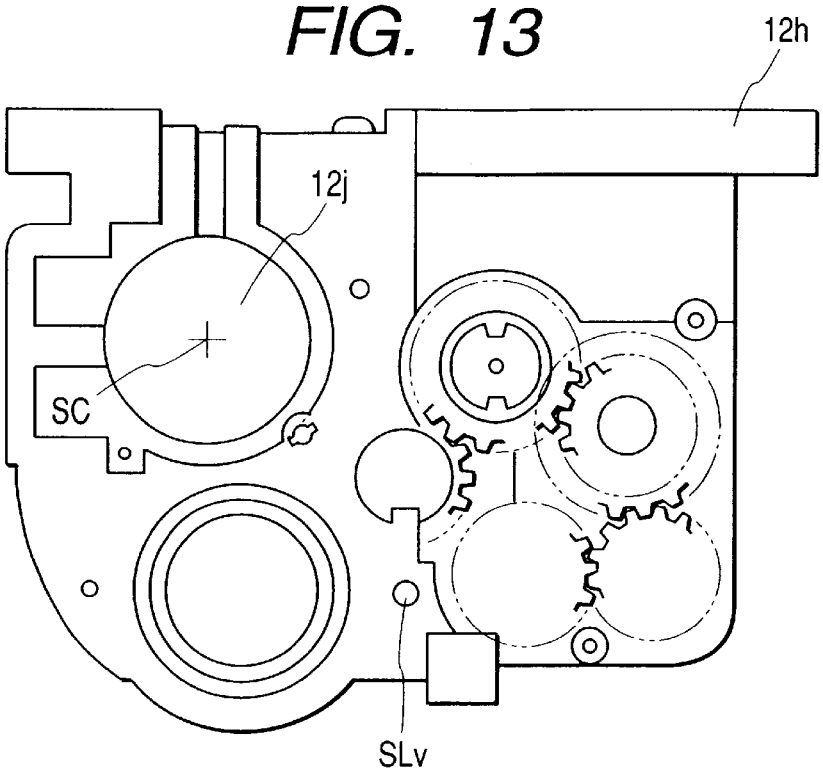
FIG. 13 is a back view showing a developing unit from which a rear cover is removed.
Figure 14:
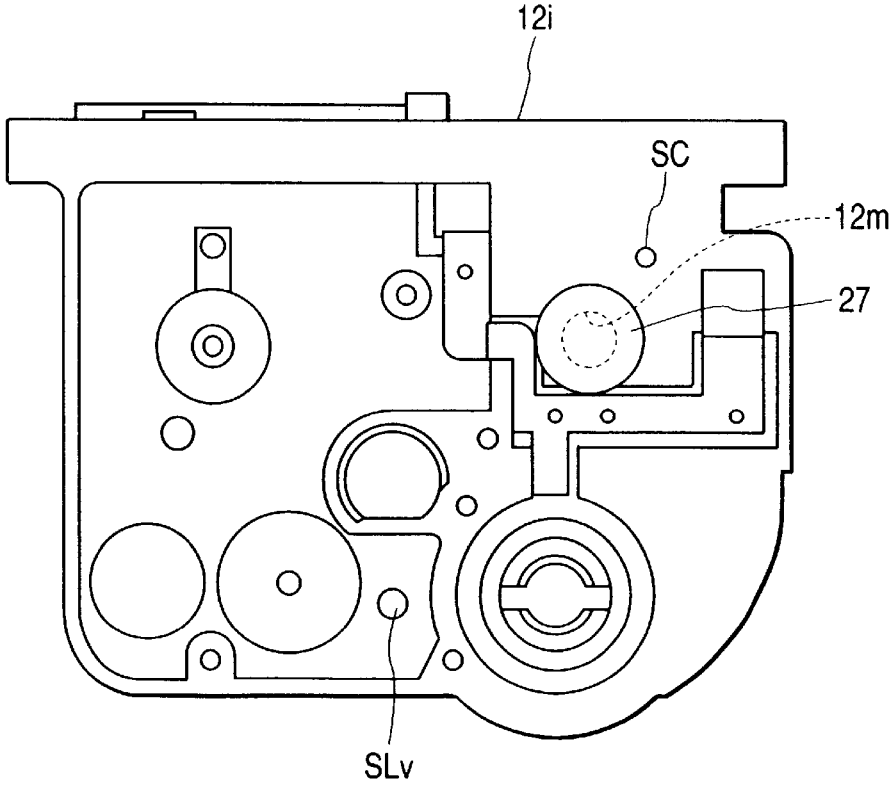
FIG. 14 is a front view showing the developing unit from which a front cover is removed.
Figure 15:
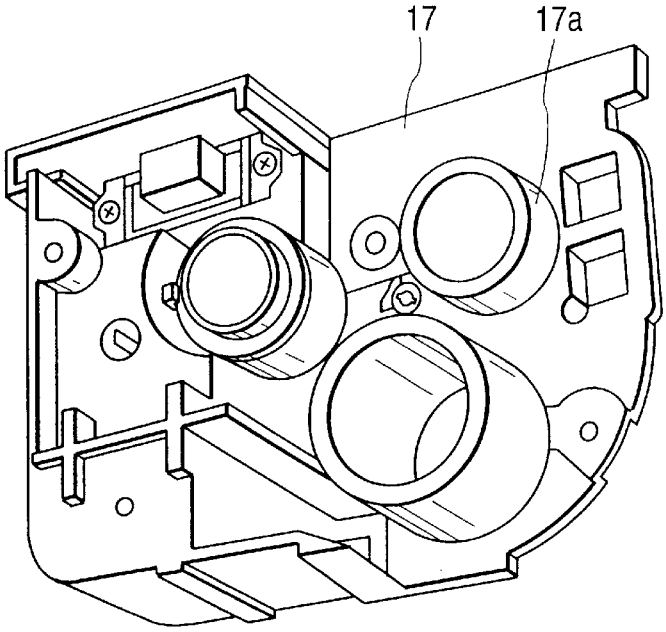
FIG. 15 is a perspective view showing an inner side of the rear cover.
Figure 16:
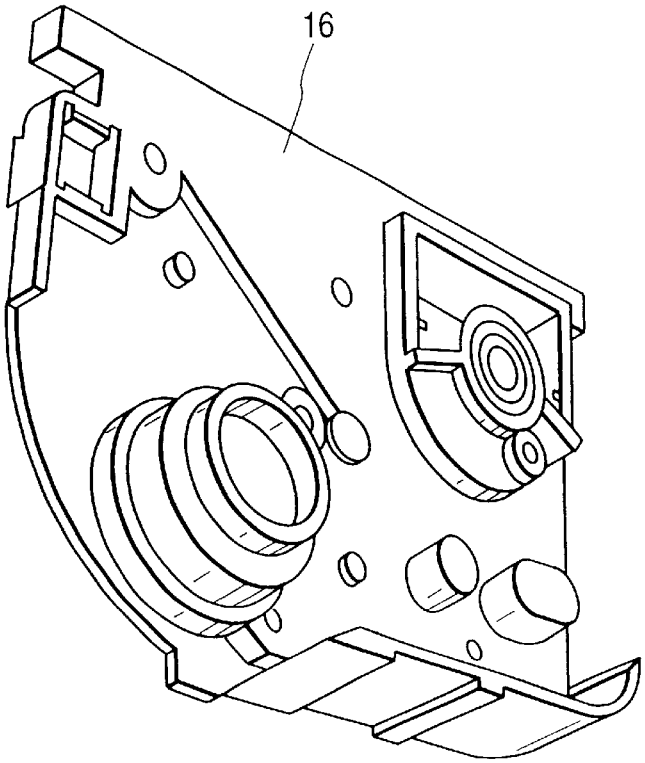
FIG. 16 is a perspective view showing an inner side of the front cover.
Figure 17:
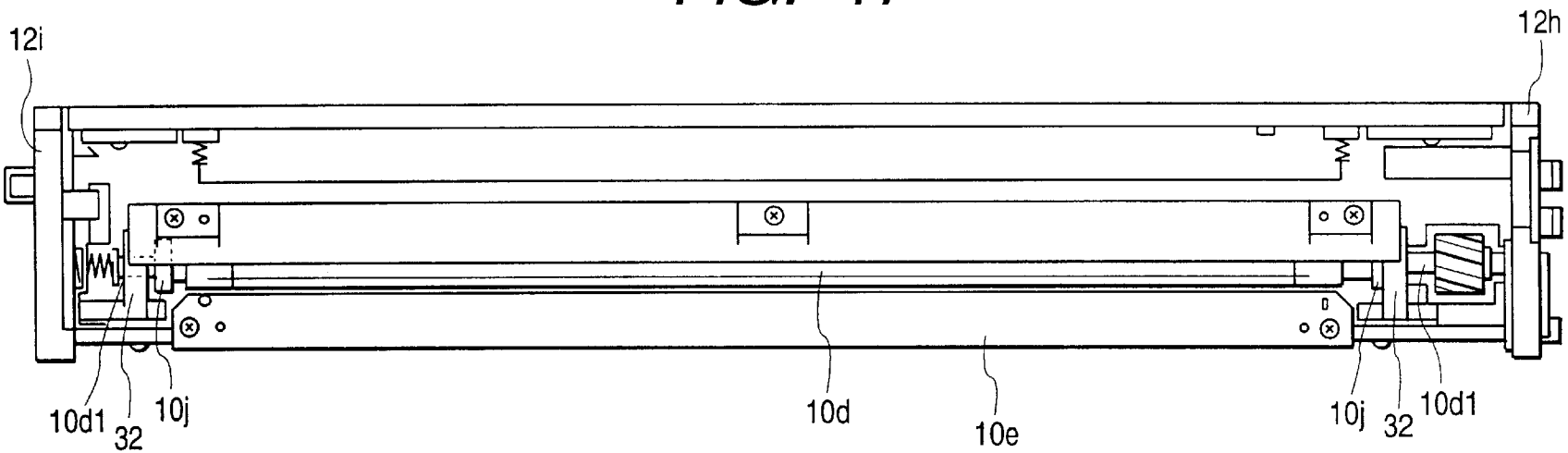
FIG. 17 is a side view showing the developing unit.

As shown in FIG. 2, the developing frame 12 receives the above-described agitating screws 10*g* and 10*h* on both sides of the partition wall 10*f*, and includes a lower portion 12*f* having a seat 12*e* for attaching the regulating blade 10*e*, a side portion 12*g* that forms a left exterior portion viewed from the mounting direction of the process cartridge B, and end plate portions 12*h* (on that side) and 12*i* (on this side) on both ends of the longitudinal direction as shown in FIGS. 13, 14 and 17. One end plate portion 12*h* has a hole 12*j* for enabling the cylindrical shaft portion 26*a* of the charging unit C to rotate through a bearing. The other end plate portion 12*i* has a hole 12*m* identical in diameter with the hole 23*a* of the charging frame 13. The cylindrical fitting hole 23*a* of the charging unit C is allowed to align with the hole 12*m* of the end plate portion 12*i* of the developing frame 12 in a state where the cylindrical shaft portion 26*a* of the charging unit C is inserted into the hole 12*j* of the end plate portion 12*h* of the developing frame 12. Then, when positioning is made in such a manner that the rear cover 17 on that side viewed from the mounting direction of the process cartridge B aligns with the end portion of the developing frame 12, the outer periphery of a hollow cylindrical shaft support portion 17*a* (refer to FIGS. 11 and 15) which projects longitudinally on the inner side of the rear cover 17 is fitted into the hole 12*j* of the developing frame 12, and at the same time, the cylindrical shaft portion 26*a* of the charging unit C is fitted into the inner periphery of the hollow cylindrical shaft support portion 17*a*. Also, the support shaft 27 which is fitted into the hole 12*m* defined in the end plate portion 12*i* of the developing frame 12 and projected therefrom (refer to FIGS. 11 and 14) is fitted into the hole 23*a* of the charging unit C. With the above structure, the charging unit C is structured in such a manner that the cylindrical shaft portion 26*a* on one end side is rotatably supported by the rear cover 17 whereas the hole 23*a* on the other end side is rotatably supported by the developing frame 12.

As shown in FIGS. 6 and 8, a top plate 29 is fixed onto the upper portion of the developing frame 12 by a small screw 28 so that the peripheral edge of the top plate 29 is abutted against the inner side of the guide portion 12*a* of the upper portion of the side portion 12*g* and the end plate portions 12*h* and 12*i*.

As shown in FIG. 2, two spring seats 29*a* are provided in the top plate 29 in two positions in the longitudinal direction. Compression coil springs 30 retained by the spring seats 29*a* are compressed and disposed between the top plate 29 and the charging frame 13. The charging unit C is urged by the spring force of the spring 30 clockwise about the pivot center SC in FIG. 2.

(Space Securing Means Between Photosensitive Drum and Charging Roller)

Figure 19:
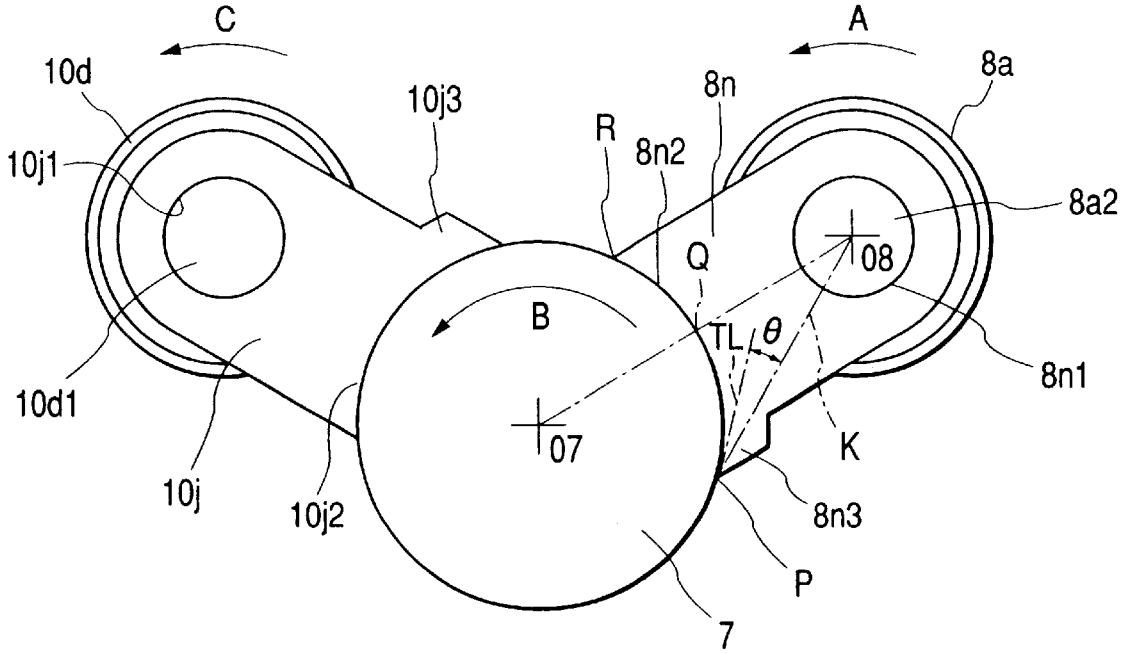
FIG. 19 is a side view showing a fitting state of a charging SD spacer and a developing SD spacer.

As shown in FIG. 11, a journal portion 8*a*2 formed by reducing the diameter of the end portion of the charging roller 8*a* and disposed around the rotating center of the charging roller 8*a* is provided with a charging SD spacer 8*n* as a space securing member for securing a space between the photosensitive drum 7 and the charging roller 8*a*. As shown in FIG. 19, the charging SD spacer 8*n* is made up of a circular hole portion 8*n*1 and an arc-shaped portion 8*n*2.

Also, the circular hole portion 8n1 of the charging SD spacer 8n is rotatably fitted into the journal portion 8a2 of the charging roller 8a, and the arc-shaped portion 8n2 is in press contact with a region out of an image formable region of the photosensitive drum 7. With the above structure, a space is defined between the photosensitive drum 7 and the charging roller 8a, and the non-transferred toner which is going to pass through an opposite portion of the charging roller 8a and the photosensitive drum 7 is caught by making the moving direction of the peripheral surface of the charging roller 8a counter to the moving direction of the peripheral surface of the photosensitive drum 7 and applying the charging bias.

As shown in FIG. 19, the rotating direction A of the charging roller 8a is the same as the rotating direction B of the photosensitive drum 7, and the arc-shaped portion 8n2 of the charging SD spacer 8n extends upstream of the photosensitive drum 7 which is in contact with the arc-shaped portion 8n2 in the rotating direction. The extension portion 8n3 functions to prevent the charging SD spacer 8n from falling down due to the rotation of the photosensitive drum 7. Because the extension portion 8n3 side comes in contact with the photosensitive drum 7 and the photosensitive drum 7 rotates in a direction indicated by an arrow B, a frictional force of the photosensitive drum 7 and the arc-shaped portion 8n2 becomes large on the extension portion 8n3 side. In order to reduce the frictional force, an angle θ shown in FIG. 19 is reduced. It is better if the angle θ is a minus angle. The angle θ is an angle formed by a tangent TL of the photosensitive drum 7 at a point P where the arc-shaped portion 8n2 initially enters the peripheral surface of the photosensitive drum 7 due to the movement of the peripheral surface of the photosensitive drum 7, and a straight line K connecting the point P and the center O8 of the charging roller 8a. In this example, assuming that a point where a line connecting the center O8 of the charging roller 8a and the center O7 of the photosensitive drum 7 crosses the arc-shaped portion 8n2 is Q, an arc QP>an arc QR. The point R is a point at which the peripheral surface of the photosensitive drum 7 leaves the arc-shaped portion 8n due to the movement of the peripheral surface of the photosensitive drum 7.

Also, the surface of the photosensitive drum 7 which is in contact with the arc-shaped portion 8n2 of the charging SD spacer 8n is made of aluminum, and the material of the charging SD spacer 8n is desirably polyether sulfone (PES) or polyphenylene sulfide (PPS) because of its high sliding property with respect to aluminum.

(Space Securing Means Between Photosensitive Drum and Developing Sleeve)

As shown in FIG. 2, the developing sleeve 10d is fitted to the developing frame 12 pivotably about the pressurizing center SLv. As shown in FIG. 17, the journal portion 10d1 that reduces the diameter of both sides of the developing sleeve 10d is provided with the developing SD spacer 10j made up of the circular hole portion and the arc-shaped portion as the space securing member of the photosensitive drum 7 and the developing sleeve 10d. The developing SD spacer 10j is made up of the circular hole portion 10j1 and the arc-shaped portion 10j2 as shown in FIG. 19. Also, the circular hole portion 10j1 of the developing SD spacer 10j is rotatably fitted into the journal portion 10d1 of the developing sleeve 10d, and the arc-shaped portion 10j2 is in press contact with a region out of an image formable region of the photosensitive drum 7. The outer side of the developing SD spacer 10j is provided with a pivotable arm 32 into which the journal 10d1 is fitted (refer to FIGS. 17 and 18).

Figure 18:
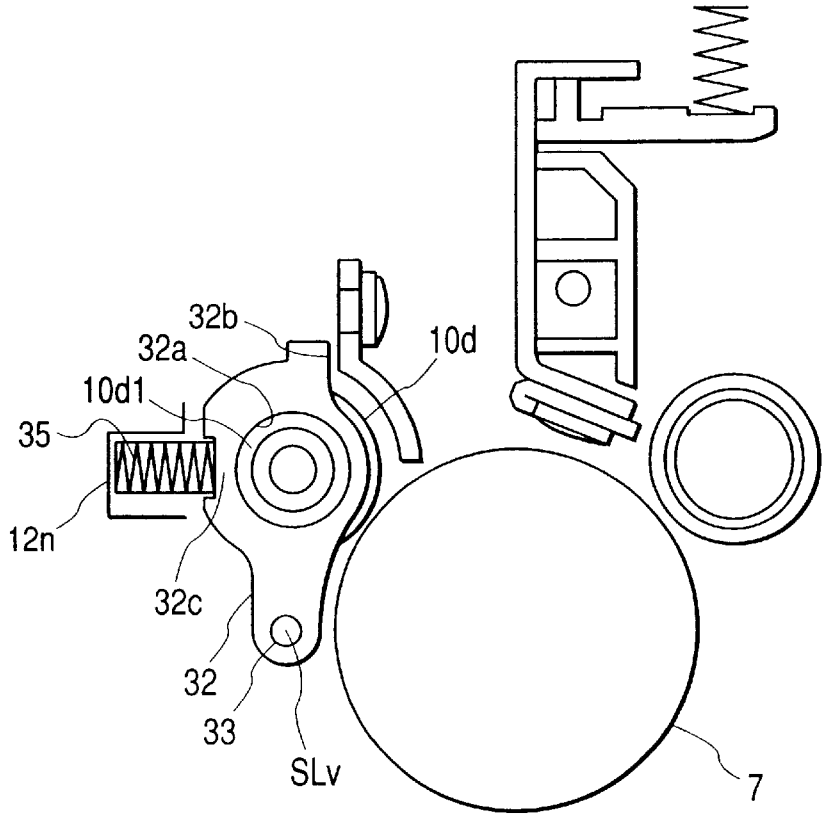
FIG. 18 is a front view showing a support portion of e developing sleeve.

FIG. 18 is a cross-sectional view showing a portion close to the side surface of the pivotable arm 32 which is perpendicular to the developing sleeve 10d. The base of the pivotable arm 32 is pivotably supported by a support shaft 33 which is press-fitted into both end plate portions 12h and 12i of the developing frame 12 in the longitudinal direction. A bearing hole 32a is defined substantially just above the support shaft 33 of the pivotable arm 32, and a stopper portion 32b is disposed above the bearing hole 32a. A spring seat 32c is disposed on a line substantially perpendicular to a line connecting the pressurizing center SLv which is the center of the support shaft 33 and the center of the bearing hole 32a.

The journal portions 10d1 on both ends of the developing sleeve 10d are rotatably supported by the bearing holes 32a of the pivotable arms 32. Compression coil springs 35 are compressed and disposed between the spring seat 32c and the spring seats 12n disposed on the end plate portions 12h and 12i of the developing frame 12. With this structure, the developing sleeve 10d rotates about the pressurizing center SLv and is pressurized toward the photosensitive drum 7, and the developing SD spacer 10j is in press contact with the end portions out of the image formable region of the photosensitive drum 7, to thereby keep a predetermined space (0.2 to 1.0 mm) between the developing sleeve 10d and the photosensitive drum 7.

As shown in FIG. 19, the rotating direction C of the developing sleeve 10d and the rotating direction B of the photosensitive drum 7 are counter so that the respective peripheral surfaces move in the opposite directions, and the arc-shaped portion 10j2 of the developing SD spacer 10j extends upstream of the photosensitive drum 7 which is in contact with the arc-shaped portion 10j2 in the moving direction of the peripheral surface of the photosensitive drum 7. The portion 10j3 functions to prevent the developing SD spacer 10j from falling down due to the rotation of the photosensitive drum 7. The arrangement of the arc-shaped portion 10j2 with respect to the photosensitive drum 7 is identical with the arrangement described with reference to the charging roller.

Also, the surface of the photosensitive drum 7 which is in contact with the arc-shaped portion 10j2 of the developing SD spacer 10j is made of aluminum, and the material of the developing SD spacer 10j is desirably polyether sulfone (PES) or polyphenylene sulfide (PPS) because of its high sliding property with respect to aluminum.

As was described above, in the above-mentioned embodiments, the space securing member which is called "SD spacer", and one side of which is a circular hole and the other side of which is arc, is employed as the space securing member. The circular hole portion of the SD spacer is substantially identical in dimensions with the shaft end portion of the developing sleeve or the charging roller, and the arc portion is substantially identical in configuration with the outer diameter of the photosensitive drum. As the structure of fitting the SD spacer, the circular hole portion of the SD spacer is rotatably fitted onto the shaft end portion of the developing roller or the charging roller, and the arc portion is abutted against the outer peripheral portion of the photosensitive drum. In this situation, the SD spacer is urged toward the abutment portion by a spring or the like as in the SD runner.

With the above structure, the SD spacer can maintain the SD gap, not while it rotates as in the SD runner, and even if the rotating directions of the photosensitive drum and the developing sleeve, or the rotating directions of the photosensitive drum and the charging roller are counter with respect to the moving directions of the respective peripheral surfaces, the influence of the peripheral speed difference is reduced as compared with a case using the SD runner. Also, because the arc portion is abutted against the photosensitive drum, which is not in contact like the SD runner at just one point but at an area, the surface pressure of the contact portion is reduced, and it becomes advantageous with respect to the wear of the SD spacer and the outer peripheral surface of the photosensitive drum, thereby being able to maintain the SD gap.

In the above embodiments, the image forming apparatus is exemplified by a laser beam printer, but the present invention is not limited to this. For example, the present invention is applicable to the image forming apparatus such as a copying machine, a facsimile machine or a word processor. Also, the present invention does not need to be limited to the process cartridge exemplified in the above embodiments. For example, the present invention may be used in the conventional image forming apparatus not using the process cartridge system. In addition, the present invention is not limited to the space securing member of the SD gap, but the present invention is also effective in the space securing member of another rotating cylindrical member such as the transfer roller.

According to the present invention, the space between two rotary members can be secured durably. Also, a space between the electrophotographic photosensitive drum and the developing sleeve, or a space between the photosensitive drum and the charging roller can be surely secured, to thereby contribute to an improvement in image quality.

While the invention has been described with reference to the structures disclosed herein, it is not confined to the details set forth and this application is intended to cover such modifications or changes as may come within the purposes of the improvements or the scope of the following claims.

What is claimed is:

1. A space securing member that defines a predetermined space between a first rotary member and a second rotary member which is arranged apart from said first rotary member with said predetermined space, wherein said space securing member is provided with a circular hole which is rotatably supported by one of said first and second rotary members, and an arc-shaped portion which is in area contact with a peripheral surface of the other of said first and second rotary members.

2. A space securing member according to claim 1, wherein a moving direction of a peripheral surface of said first rotary member is counter to a moving direction of a peripheral surface of said second rotary member.

3. A space securing member according to claim 1, wherein an arc shape of said arc-shaped portion is substantially complemental to the peripheral surface of the other of said first and second rotary members against which said space securing member is abutted.

4. A space securing member according to claim 1, wherein said arc-shaped portion extends upstream of the peripheral surface of the other of said first and second rotary members in a moving direction so that said arc-shaped portion is not dragged by the other of said first and second rotary members which is in contact with said arc-shaped portion.

5. A space securing member according to claim 1, wherein said space securing member is made of polyether sulfone (PES) or polyphenylene sulfide (PPS).

6. A space securing member according to claim 1, wherein when the relationship between the diameter A of said first rotary member and the diameter B of said second rotary member satisfies A<B, said circular hole portion is fitted onto said first rotary member, and said arc-shaped portion is in contact with said second rotary member.

7. A space securing member according to claim 1, wherein one of said first rotary member and said second rotary member comprises an electrophotographic photosensitive drum.

8. A developing device for developing an electrostatic latent image formed on an electrophotographic photosensitive drum with toner, said developing device comprising:

a developing roller; and a space securing member that defines a space between said developing roller and said electrophotographic photosensitive drum, said space securing member being rotatably supported by said developing roller and provided with an arc-shaped portion which is in area contact with an outer peripheral surface of said electrophotographic photosensitive drum.

9. A charging device for charging an electrophotographic photosensitive drum, said charging device comprising:

a charging roller; and a space securing member that defines a space between said charging roller and said electrophotographic photosensitive drum, said space securing member being rotatably supported by said charging roller and provided with an arc-shaped portion which is in area contact with an outer peripheral surface of said electrophotographic photosensitive drum.

10. A process cartridge detachably mountable on a main body of an image forming apparatus, said process cartridge comprising:

an electrophotographic photosensitive drum;

a developing roller for developing an electrostatic latent image formed on said electrophotographic photosensitive drum with toner; and a space securing member that defines a space between said developing roller and said electrophotographic photosensitive drum, said space securing member being rotatably supported by said developing roller and provided with an arc-shaped portion which is in area contact with an outer peripheral surface of said electrophotographic photosensitive drum.

11. A process cartridge detachably mountable on a main body of an image forming apparatus, said process cartridge comprising:

an electrophotographic photosensitive drum;

a charging roller for charging said electrophotographic photosensitive drum; and a space securing member that defines a space between said charging roller and said electrophotographic photosensitive drum, said space securing member being rotatably supported by said charging roller and provided with an arc-shaped portion which is in area contact with an outer peripheral surface of said electrophotographic photosensitive drum.

12. A process cartridge detachably mountable on a main body of an image forming apparatus, said process cartridge comprising:

an electrophotographic photosensitive drum;

a developing roller for developing an electrostatic latent image formed on said electrophotographic photosensitive drum with toner;

a space securing member that defines a space between said developing roller and said electrophotographic photosensitive drum, said space securing member being rotatably supported by said developing roller and provided with an arc-shaped portion which is in area contact with an outer peripheral surface of said electrophotographic photosensitive drum;

a charging roller for charging said electrophotographic photosensitive drum; and a space securing member that defines a space between said charging roller and said electrophotographic photosensitive drum, said space securing member being rotatably supported by said charging roller and provided with an arc-shaped portion which is in area contact with an outer peripheral surface of said electrophotographic photosensitive drum.

13. A process cartridge according to any one of claims 10 to 12, further comprising cleaning means for removing the toner remaining on said electrophotographic photosensitive drum after the toner has been transferred from said electrophotographic photosensitive drum.

* * * * *

UNITED STATES PATENT AND TRADEMARK OFFICE

CERTIFICATE OF CORRECTION

PATENT NO. : 6,385,416 B1
DATED : May 7, 2002
INVENTOR(S) : Tadashi Horikawa et al.

It is certified that error appears in the above-identified patent and that said Letters Patent is hereby corrected as shown below:

Title page,
Item [56], References Cited, U.S. PATENT DOCUMENTS, "Watamabe et al." should read -- Watanabe et al. --.

Column 3,
Line 22, "e" should read -- the --.

Column 5,
Line 33, "and" should read -- and is --.

Signed and Sealed this

Twenty-second Day of October, 2002

*Attest:*

*Attesting Officer*

JAMES E. ROGAN
*Director of the United States Patent and Trademark Office*